US006841743B2

(12) United States Patent
Okada et al.

(10) Patent No.: US 6,841,743 B2
(45) Date of Patent: Jan. 11, 2005

(54) MULTIDIRECTIONAL CONTROL SWITCH AND MULTIDIRECTIONAL INPUT DEVICE USING THE SAME

(75) Inventors: Hiroyasu Okada, Hyogo (JP); Masaki Sawada, Osaka (JP); Hiroto Inoue, Kyoto (JP); Tamotsu Yamamoto, Hyogo (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/642,672

(22) Filed: Aug. 19, 2003

(65) Prior Publication Data

US 2004/0080395 A1 Apr. 29, 2004

(30) Foreign Application Priority Data

Sep. 9, 2002 (JP) ..... 2002-262417

(51) Int. Cl.[7] ..... H01H 25/04
(52) U.S. Cl. ..... 200/6 A; 200/5 R; 338/99
(58) Field of Search ..... 200/1 B, 1 R, 200/5 A, 5 R, 512–517, 6 A, 17 R, 18; 338/92–99, 71, 114, 185, 154

(56) References Cited

U.S. PATENT DOCUMENTS 4,246,452 A * 1/1981 Chandler ..... 200/5 A
5,313,027 A * 5/1994 Inoue et al. ..... 200/5 A
5,689,285 A * 11/1997 Asher ..... 200/6 R
6,087,925 A * 7/2000 DeVolpi ..... 338/92
6,313,731 B1 * 11/2001 Vance ..... 338/185
6,399,904 B1 * 6/2002 Mimata ..... 200/6 A

FOREIGN PATENT DOCUMENTS

JP 2002-117751 4/2002
WO 02/13219 2/2002

* cited by examiner

*Primary Examiner*—Lincoln Donovan
*Assistant Examiner*—M. Fishman
(74) *Attorney, Agent, or Firm*—Wenderoth, Lind & Ponack, L.L.P.

(57) ABSTRACT

A multidirectional control switch of the present invention is used in a variety of electronic apparatuses including a portable telephone and a personal digital assistant. A first switch contact of this switch outputs a first signal continuously varying as a top surface of a substantially disc-shaped operating member undergoes a sliding press along a locus substantially in arc form. With a stronger press, a second switch contact outputs a second signal. The multidirectional control switch has a simple structure and can be reduced in size because these two switch contacts are integrally formed, thereby eliminating a need to combine discrete elements.

21 Claims, 8 Drawing Sheets

MULTIDIRECTIONAL CONTROL SWITCH AND MULTIDIRECTIONAL INPUT DEVICE USING THE SAME

BACKGROUND OF THE INVENTION

1. Field of the Invention

The present invention relates to a multidirectional control switch used in a variety of electronic apparatuses including a portable telephone and a portable information terminal such as a personal digital assistant, and also relates to a multidirectional input device using the multidirectional control switch.

2. Background Art

Recently, various electronic apparatuses including a portable telephone and a personal digital assistant have become more functional. These apparatuses use increasing numbers of control switches, each formed of a combination of switches of various operations such as rolling and pressing. Such a control switch has an operating knob used for combined control of the electronic apparatus.

The portable telephone uses, for example, a switch allowing an operating knob to be rolled and pressed. The operating knob of such a switch is, for example, rolled to operate a rotary encoder for selecting a specified telephone number from a plurality of telephone numbers displayed on a display unit of the portable telephone. Pressing this operating knob in a direction different from a direction in which the knob is rolled moves a substrate holding a rotary encoder, whereby a push switch below this substrate is actuated. Consequently, the selected telephone number is called.

Such a switch is disclosed, for example, in Japanese Patent Unexamined Publication No. 2002-117751.

In the above-described conventional control switch, plural switches of various operations such as rolling and pressing are combined, and one operating knob is used for these operations. This limits placement or structure of each element and results in increased overall space, causing hard size reduction.

SUMMARY OF THE INVENTION

In a multidirectional control switch of the present invention, a first switch contact outputs a first signal continuously varying as a top surface of a disc-shaped operating member undergoes a sliding press along a locus in arc form. With a stronger press, a second switch contact outputs a second signal. In a multidirectional input device of this invention, a controller is connected to the multidirectional control switch and a display unit. The controller controls display on the display unit upon detection of the first signal and the second signal of the multidirectional control switch.

DETAILED DESCRIPTION OF THE PREFERRED EMBODIMENTS FIRST EXEMPLARY EMBODIMENT

Figure 1:
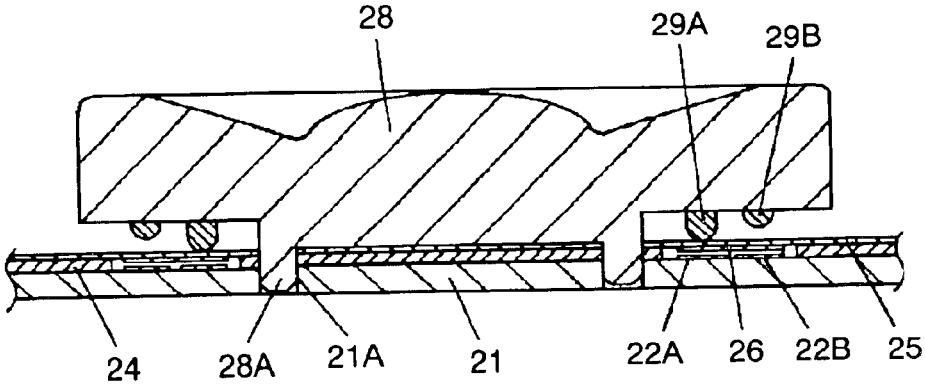
FIG. 1 is a sectional view of a multidirectional control switch in accordance with a first exemplary embodiment of the present invention.
Figure 2:
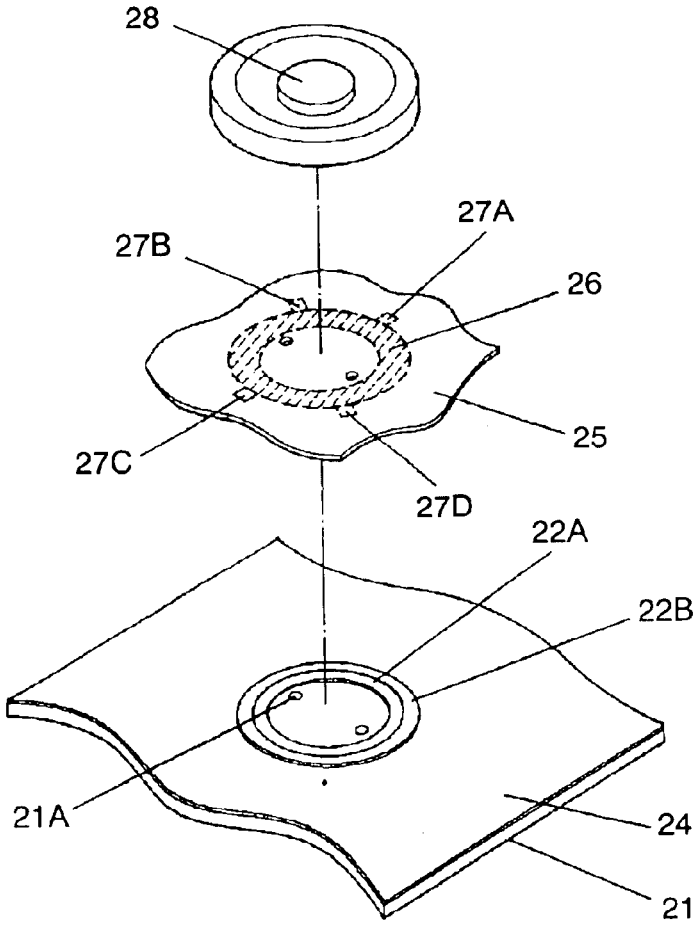
FIG. 2 is an exploded perspective view of the multidirectional control switch in accordance with the first embodiment of this invention.

FIGS. 1 and 2 are a sectional view and an exploded perspective view, respectively, of a multidirectional control switch in accordance with a first exemplary embodiment of the present invention.

Top and bottom surfaces of insulating substrate (hereinafter referred to as "substrate") 21 are formed with a plurality of wiring patterns (not shown). The top surface of substrate 21 is also formed with two substantially ring-shaped conductive layers 22A, 22B. These conductive layers 22A, 22B are good conductors made of copper or the like and are concentric and electrically independent of each other. Resistive sheet (hereinafter referred to as "sheet") 25 is provided above substrate 21 and is made of a flexible film of polyethylene terephthalate or the like. This sheet 25 is formed with ring-shaped resistive layer 26 made of carbon or the like at its surface facing conductive layers 22A, 22B. Spacer 24 having a through hole in a center thereof is placed between substrate 21 and sheet 25, whereby conductive layers 22A, 22B face resistive layer 26 across a given clearance. With this structure, resistive layer 26 forms a first switch contact in cooperation with inner conductive layer 22A and a second switch contact in cooperation with outer conductive layer 22B.

Substantially disc-shaped operating member 28 is made of, for example, elastic rubber or elastomer and is provided above sheet 25. Operating member 28 has, in the vicinity of a center of its bottom surface, two bosses 28A forcibly fixed into respective holes 21A of substrate 21. Ring-shaped inner projection 29A projects from a border of the bottom surface of operating member 28 and has a round end contacting a top surface of sheet 25 above conductive layer 22A. Similarly to projection 29A, projection 29B is ring-shaped, and its round end projects toward sheet 25 above conductive layer 22B with a given clearance left between the end of projection 29B and sheet 25. The multidirectional control switch of the present embodiment is thus constructed.

The multidirectional control switch of this embodiment has only four components including substrate 21, spacer 24, sheet 25 and operating member 28. Moreover, the ring-shaped conductive layers and the resistive layer integrally form its two switch contacts. This eliminates a need to combine discrete elements. Thus, the structure is simple and facilitates size reduction.

Figure 3:
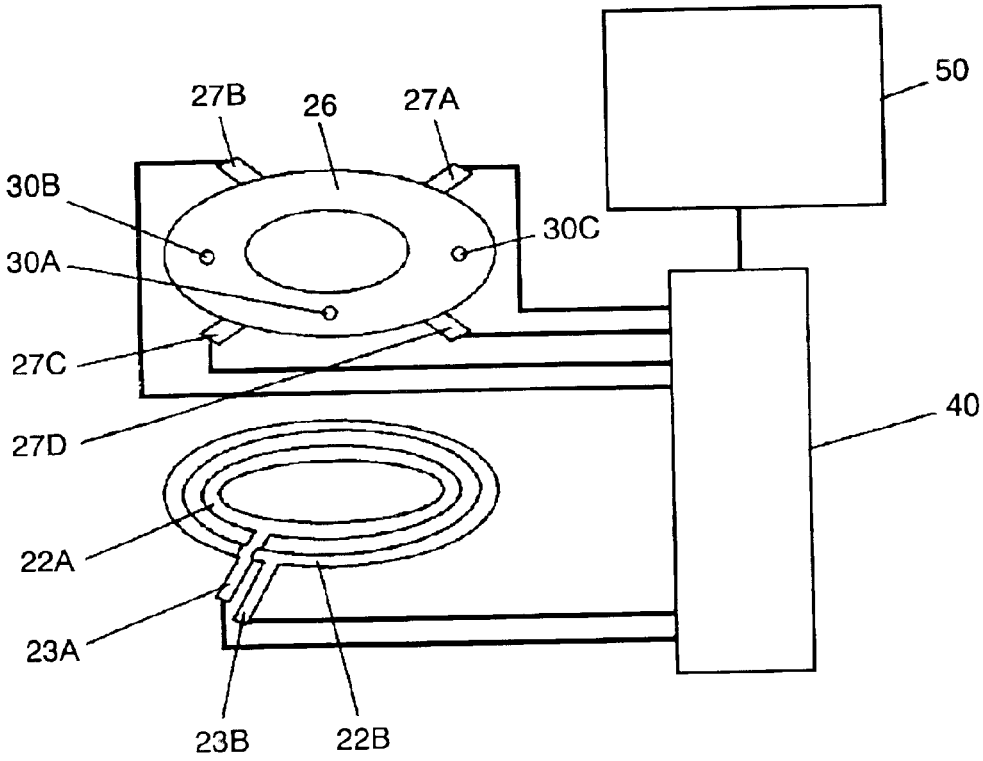
FIG. 3 is a conceptual illustration of a multidirectional input device in accordance with the first embodiment of this invention.

As shown in FIG. 3, resistive layer 26 is provided with four substantially evenly spaced leads 27A, 27B, 27C, 27D, and conductive layers 22A, 22B are provided with leads 23A, 23B, respectively. A multidirectional input device is constructed with leads 27A–27D, 23A, 23B and display unit 50 connected to controller 40. Display unit 50 is formed of a liquid crystal display element or the like, while controller 40 is formed of, for example, a microcomputer mounted to substrate 21.

A description will be provided hereinafter of operation of the above-constructed multidirectional input device used, for example, in a portable telephone. In the following description, a user selects a specified telephone number from a plurality of telephone numbers displayed on display unit 50 and then calls the selected telephone number.

Figure 4A:
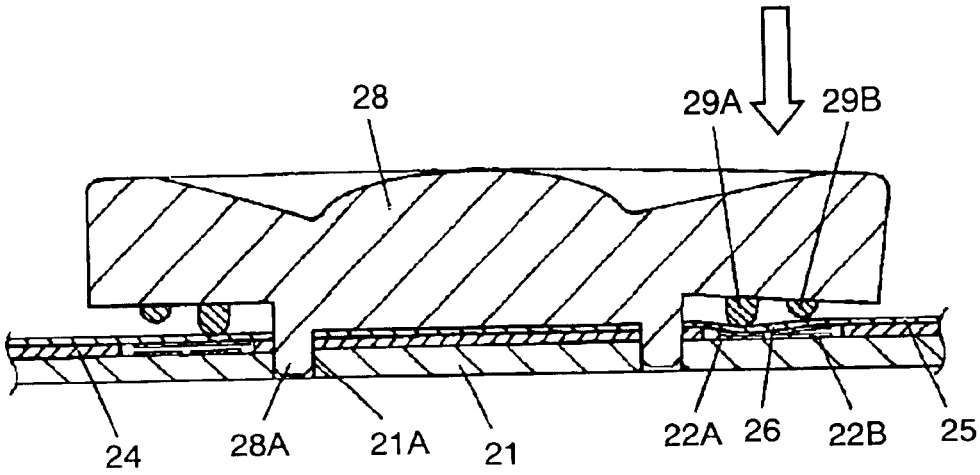
FIGS. 4A and 4B are sectional views of the multidirectional control switch undergoing pressing in accordance with the first embodiment of this invention.

When an outer portion of a top surface of operating member 28 is pressed by a given force of a finger or the like as shown in FIG. 4A, operating member 28 tilts, whereby inner projection 29A on the bottom surface of operating member 28 presses the top surface of sheet 25 which thus bows downwardly. Accordingly, resistive layer 26 on the bottom surface of sheet 25 is brought into contact with inner conductive layer 22A, thus effecting electrical conduction between resistive layer 26 and conductive layer 22A. This electrical conduction is output to controller 40. In a case where point 30A shown in FIG. 3 is pressed, controller 40 first applies a voltage to lead 27A, using lead 27C as a ground and determines, based on a resistance output from lead 23A, that one of points 30A, 30B is pressed. Next, controller 40 applies a voltage to lead 27B, using lead 27D as a ground and determines, in the same manner as described above, that one of points 30A, 30C is pressed. Based on these determinations, controller 40 detects point 30A as a pressed position.

When the finger is slid clockwise substantially along an arc while pressing and holding the top surface of operating member 28, a position of contact between resistive layer 26 and conductive layer 22A varies clockwise, and resistance varies accordingly. For example, the resistance continuously decreases. This varying resistance is output as a first signal from the first switch contact to controller 40. Since the first switch contact is formed by ring-shaped conductive layer 22A and ring-shaped resistive layer 26, the resistance can be varied continuously. Moreover, providing projection 29A ensures actuation of the first switch contact. Further, shaping projection 29A into a ring allows the user to perform a smooth sliding press substantially along the arc.

Upon detection of a first signal, controller 40, for example, moves a strip-shaped cursor or an arrow-shaped pointer downwardly over the plurality of telephone numbers displayed on display unit 50 when the first signal varies clockwise. Conversely, controller 40 moves the cursor or the like upwardly upon detection of a signal continuously varying when a counterclockwise sliding press is performed substantially along the arc.

Figure 4B:
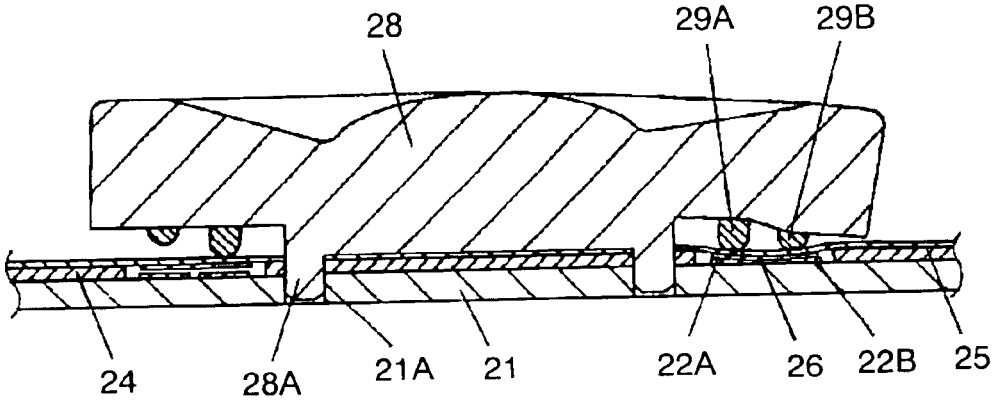

When the top surface of operating member 28 is pressed by a greater operating force with the cursor or the like lying on a desired telephone number, operating member 28 tilts further as shown in FIG. 4B, whereby not only projection 29A but also projection 29B presses the top surface of sheet 25 which thus bows downwardly. Accordingly, resistive layer 26 on the bottom surface of sheet 25 is brought into contact with outer conductive layer 22B, thus effecting electrical conduction between resistive layer 26 and conductive layer 22B. A corresponding resistance is output as a second signal from the second switch contact to controller 40. Upon detection of the second signal, controller 40 causes a transmitting section (not shown) or the like to call the selected telephone number. Providing projection 29B can ensure actuation of the second switch contact.

According to the present embodiment described above, when substantially disc-shaped operating member 28 undergoes a sliding press along a locus substantially in arc form, the first switch contact outputs a continuously varying first signal accordingly. With a stronger press, the second switch contact outputs a second signal. In the multidirectional control switch thus constructed, the two switch contacts are integrally formed, thus eliminating a need to combine discrete elements. For this reason, the multidirectional control switch obtained has a simple structure and can be reduced in size. The multidirectional input device using the above-described multidirectional control switch, for example, moves the cursor or pointer on the display unit in accordance with the first signal for selection of the telephone number or the like and detects the second signal to confirm this selected function. With such a simple structure, the multidirectional input device obtained can be reduced in size.

It is preferable that controller 40 should not detect the second signal while detecting the continuously varying first signal. This prevents improper actuation or the like, because while the telephone number is being selected with operating member 28 undergoing a sliding press, controller 40 does not detect the second signal output by mistake as a result of the top surface of member 28 being pressed by a greater operating force.

In the above description, concentric conductive layers 22A, 22B are formed on the top surface of substrate 21, and resistive layer 26 forms the first switch contact in cooperation with inner conductive layer 22A and the second switch contact in cooperation with outer conductive layer 22B. However, the present invention can be carried out even when a push switch or the like is provided as the second switch contact in an outer region close to inner conductive layer 22A formed as the first switch contact on the top surface of substrate 21.

Figure 5:
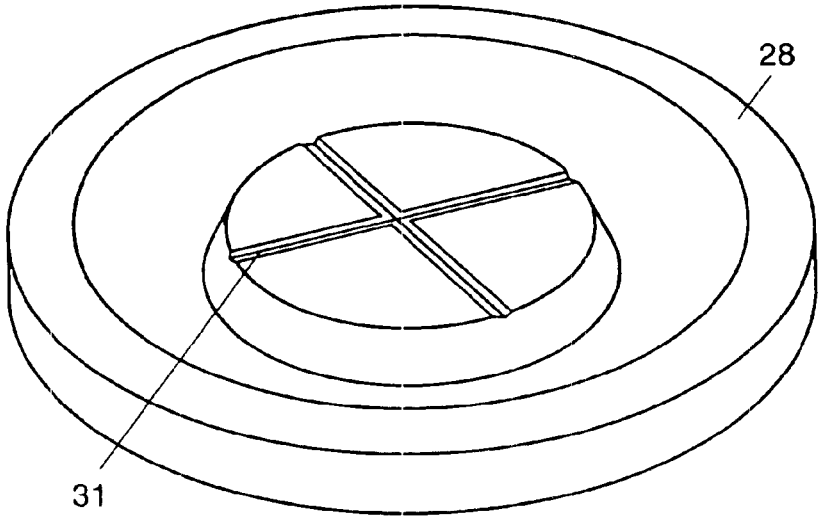
FIG. 5 is a perspective view of an operating member of the multi-directional control switch in accordance with the first embodiment of this invention.

As shown in FIG. 5, linear recessed parts 31 are desirably provided in the top surface of operating member 28 so as to extend radially and outwardly from a substantially central portion of operating member 28. This facilitates use of the multidirectional control switch because an area to be pressed becomes easy to be identified when a sliding press is performed substantially along the arc with a finger or the like. In FIG. 5, two linear recessed parts 31 arc provided. However, the number of recessed parts 31 is not limited, and recessed parts 31 do not necessarily need to be integrally connected. In place of recessed part 31, a projected part having the same shape as recessed part 31 may be provided.

Second Exemplary Embodiment

Figure 6:
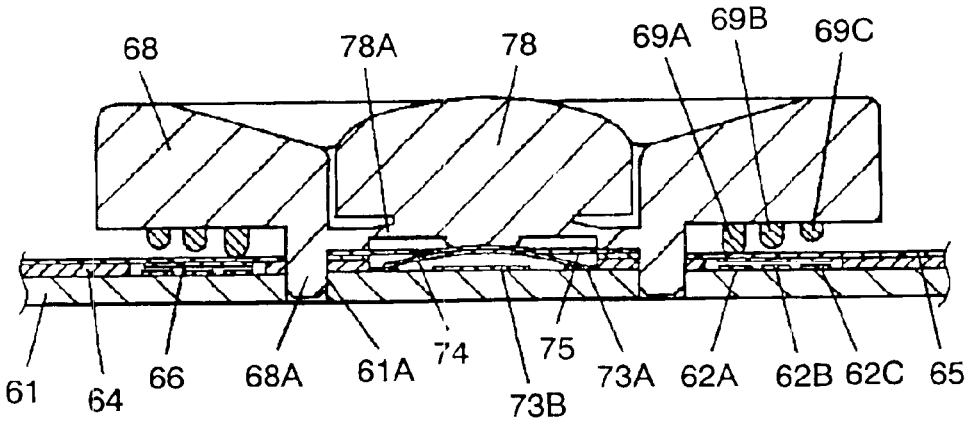
FIG. 6 is a sectional view of a multidirectional control switch in accordance with a second exemplary embodiment of this invention.

FIG. 6 is a sectional view of a multidirectional control switch in accordance with a second exemplary embodiment of the present invention.

Top and bottom surfaces of insulating substrate (hereinafter referred to as "substrate") 61 are formed with a plurality of wiring patterns (not shown). The top surface of substrate 61 is also formed with three substantially ring-shaped conductive layers 62A, 62B, 62C. These conductive layers 62A, 62B, 62C are good conductors and are concentric and electrically independent of one another. Substrate 61 is provided with ring-shaped outer contact (hereinafter referred to as "contact") 73A and central contact (hereinafter referred to as "contact") 73B at its central portion. Resistive sheet (hereinafter referred to as "sheet") 65 is provided above substrate 61 and is formed with ring-shaped resistive layer 66 at its surface facing conductive layers 62A, 62B, 62C. Spacer 64 is placed between substrate 61 and sheet 65, whereby conductive layers 62A, 62B, 62C face resistive layer 66 across a given clearance. Resistive layer 66 thus forms a first switch contact in cooperation with innermost conductive layer 62A, a second switch contact in cooperation with intermediate conductive layer 62B and a third switch contact in cooperation with outermost conductive layer 62C. Sheet 65, the conductive layers and resistive layer 66 are made of the same materials as those in the first embodiment. With the third switch contact provided in this way, assembly of the multidirectional control switch becomes simple and easy as in the first embodiment.

Domed movable contact (hereinafter referred to as "contact") 74 is made of sheet metal and is resilient. Contact 74 is so mounted that its central portion faces contact 73B across a given clearance with a border of its bottom surface disposed on contact 73A. In this way, contacts 73A, 73B, 74 form a fourth switch contact.

As in the first embodiment, substantially disc-shaped operating member 68 has projections 69A, 69B. Operating member 68 also has third projection 69C around projection 69B. Similarly to projections 69A, 69B, projection 69C is ring-shaped. Clearance between an end of projection 69C and sheet 65 is more than clearance between an end of inner projection 68B and sheet 65. Providing projection 69C ensures actuation of the third switch contact in the same manner as in the first embodiment.

Push button 78 is provided above contact 74 via flexible sheet 75 formed of a film of polyethylene terephthalate or the like. Button 78 formed at a center of operating member 68, is integrally connected to operating member 68 by thin-walled part 78A and is vertically movable. In this way, the multidirectional control switch of the present embodiment is constructed.

Figure 7:
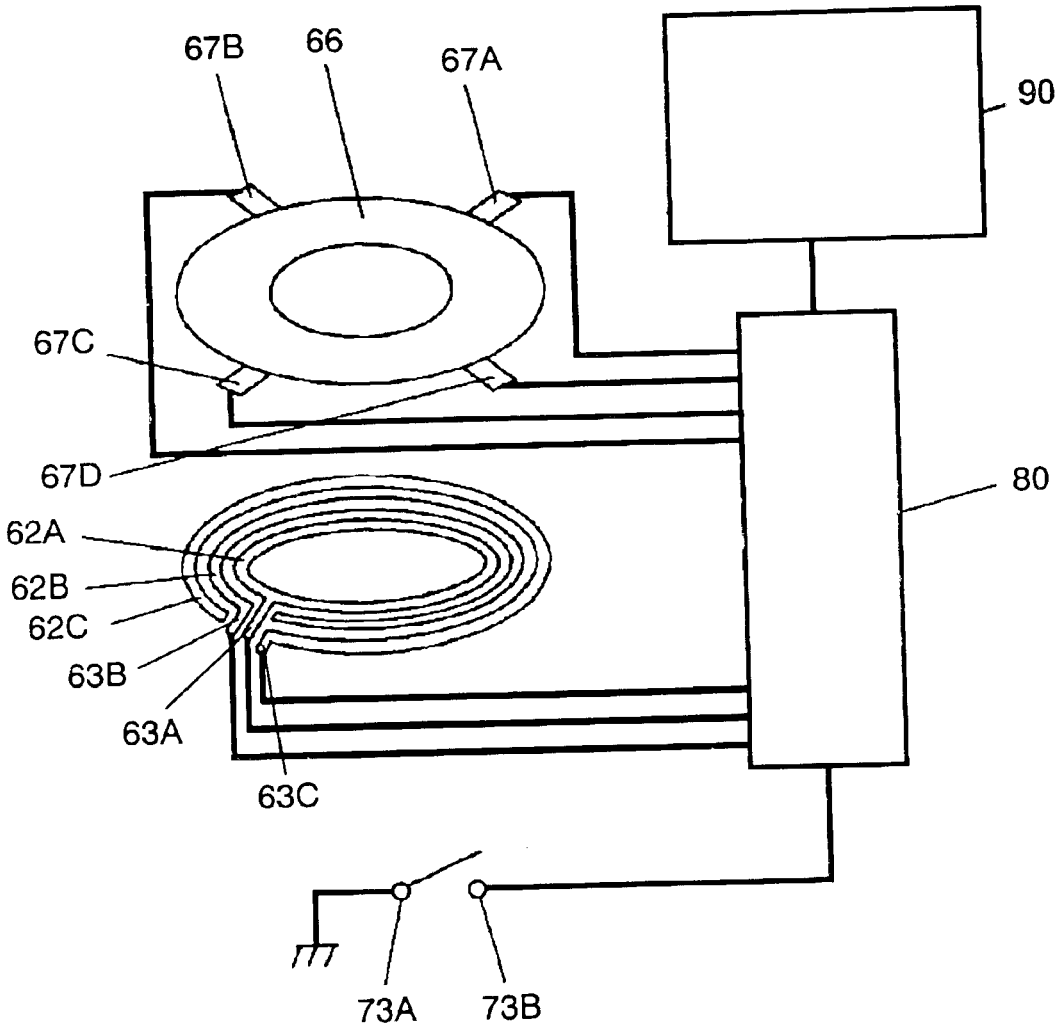
FIG. 7 is a conceptual illustration of a multidirectional input device in accordance with the second embodiment of this invention.

As shown in FIG. 7, resistive layer 66 is provided with four substantially evenly spaced leads 67A–67D, and conductive layers 62A–62C are provided with leads 63A–63C, respectively. Leads 67A–67D, 63A–63C and display unit 90 are connected to controller 80. Contact 73A is connected to a ground, while contact 73B is connected to controller 80. In this way, a multidirectional input device is constructed. Display unit 90 is formed of a liquid crystal display element or the like, while controller 80 is formed of, for example, a microcomputer mounted to substrate 61.

A description will be provided hereinafter of operation of the above-constructed multidirectional input device used, for example, in a personal digital assistant. In the following description, a user selects a desired place by changing a size of a map displayed on display unit 90 or moving a displayed indicator, and then causes display of a telephone number, an address or the like of the selected place.

Figure 8A:
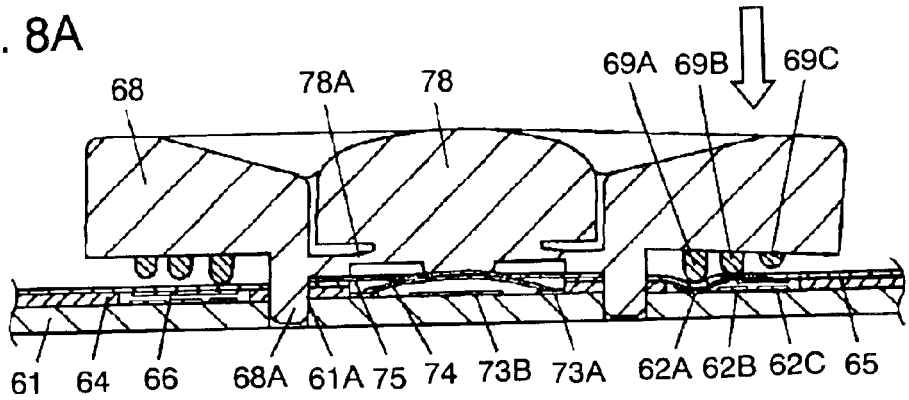
FIGS. 8A–8C are sectional views of the multidirectional control switch undergoing pressing in accordance with the second embodiment of this invention.
Figure 10A:
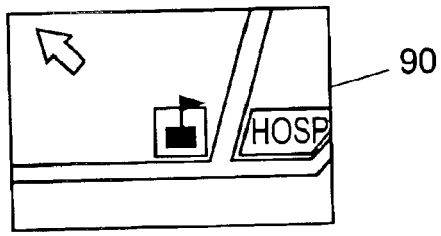
FIG. 10A illustrates a display on a display unit of a multidirectional input device in accordance with the second embodiment of this invention.

When an outer portion of a top surface of operating member 68 is pressed by a given force of a finger or the like as shown in FIG. 8A with a specified map of FIG. 10A displayed on display unit 90, operating member 68 tilts, whereby innermost projection 69A on a bottom surface of operating member 68 presses the top surface of sheet 65 which thus bows downwardly. Accordingly, resistive layer 66 on the bottom surface of sheet 65 is brought into contact with innermost conductive layer 62A, thus effecting electrical conduction between resistive layer 66 and conductive layer 62A. This electrical conduction is output to controller 80, which determines a pressed position in the same manner as in the first embodiment. When the finger is slid, for example, clockwise substantially along an arc while pressing and holding the top surface of operating member 68, a position of contact between resistive layer 66 and conductive layer 62A varies clockwise, and a resistance continuously varies accordingly. This continuously varying resistance is output as a first signal to controller 80.

Figure 10B:
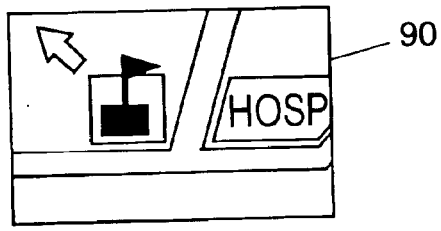
FIG. 10B illustrates a display obtained by magnifying the display of FIG. 10A.
Figure 10C:
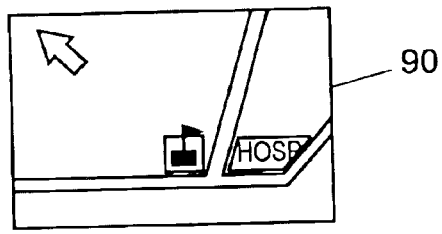
FIG. 10C illustrates a display obtained by scaling down the display of FIG. 10A.

Upon detection of this first signal, controller 80 displays a magnified map on display unit 90, as shown in FIG. 10B. Conversely, controller 80 provides a reduced map such as illustrated by FIG. 10C upon detection of the first signal when a counterclockwise sliding press is performed substantially along the arc.

Figure 8B:
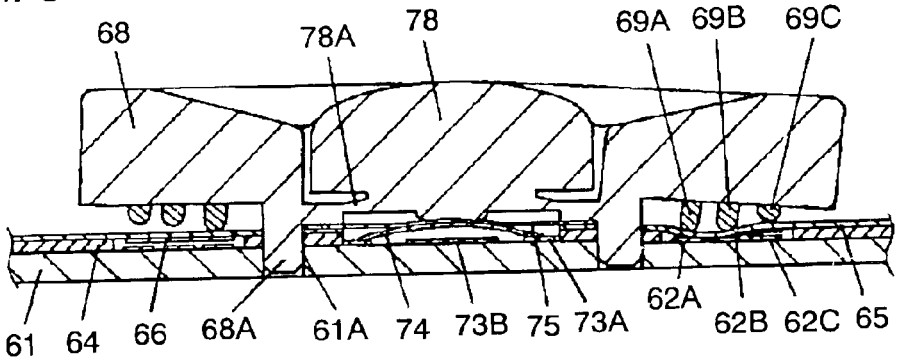
Figure 10D:
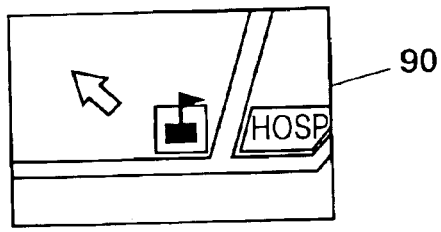
FIG. 10D illustrates a display with a pointer moved from its position in the display of FIG. 10A.

When a lower-right portion of the top surface of operating member 68 is pressed by a greater operating force with the map changed to the desired size such as illustrated by FIG. 10A, operating member 68 tilts further in a lower-right direction as shown in FIG. 8B, whereby not only innermost projection 69A but also intermediate projection 69B on the bottom surface of operating member 68 presses the top surface of sheet 65 which thus bows downwardly. Accordingly, resistive layer 66 on the bottom surface of sheet 65 is brought into contact with intermediate conductive layer 62B, thus effecting electrical conduction between resistive layer 66 and conductive layer 62B. A corresponding resistance is output as a second signal to controller 80. Upon detection of the second signal, controller 80 moves an arrow-shaped pointer from a previously located upper-left position in a lower-right direction as shown in FIG. 10D.

Figure 8C:
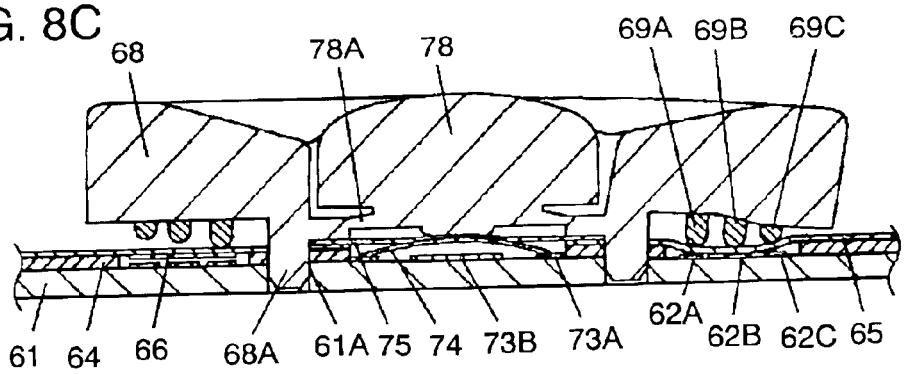

When the top surface of operating member 68 is pressed by an operating force greater than that exerted in FIG. 8B, operating member 68 tilts further in the lower-right direction as shown in FIG. 8C, whereby not only innermost and intermediate projections 69A, 69B but also outermost projection 69C on the bottom surface of operating member 68 presses the top surface of sheet 65 which thus bows downwardly. Accordingly, resistive layer 66 on the bottom surface of sheet 65 is brought into contact with outermost conductive layer 62C, thus effecting electrical conduction between resistive layer 66 and conductive layer 62C. A corresponding resistance is output as a third signal to controller 80. Upon detection of the third signal, controller 80 accelerates movement of the pointer in the lower-right direction.

Figure 9:
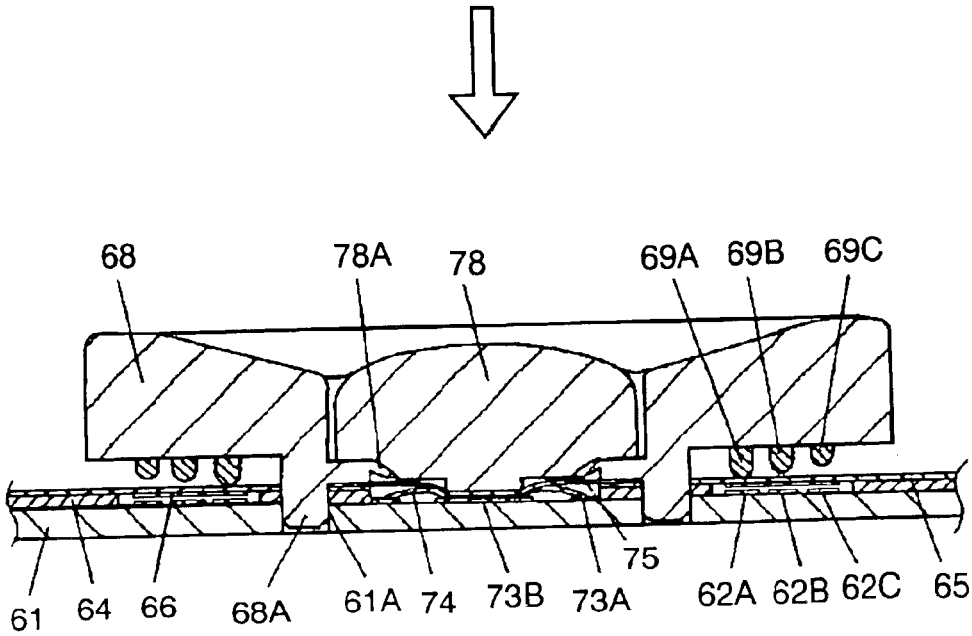
FIG. 9 is a sectional view of the multidirectional control switch with a push button at a center of the control switch pressed in accordance with the second embodiment of this invention.
Figure 10E:
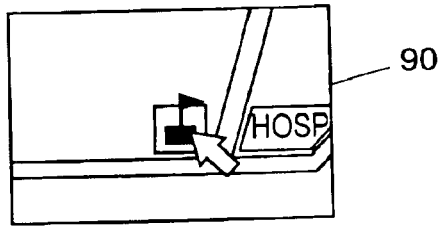
FIG. 10E illustrates a display with the pointer moved from its position in the display of FIG. 10D.

Thereafter, push button 78 is pressed downwardly as shown in FIG. 9 with the pointer located in a desired position such as shown in FIG. 10E. Consequently, button 78 bows thin-walled part 78A and sheet 75, thus pressing a top part of contact 74. Accordingly, contact 74 is turned inside out, whereby its central portion comes into contact with contact 73B, thereby effecting electrical conduction between contact 73A and contact 73B. With this electrical conduction, a fourth signal is output to controller 80. Controller 80 is constructed to display the telephone number, the address or the like of the selected place upon detection of the fourth signal. In FIG. 10E, a school is selected.

According to the present embodiment, the third switch contact is provided to output the third signal when operating member 68 is pressed by a force greater than a force which acts on the second switch contact. This allows switching between more functions. In the above description, a moving speed of the pointer or the like which is displayed on the display unit is varied.

Push button 78 is disposed at the center of operating member 68 to be vertically movable, and the fourth switch contact is provided to perform electrical connection and disconnection at the press of button 78. Thus, operating not only substantially disc-shaped operating member 68 but also button 78 provided at the center of operating member 68 allows more functions to undergo switching or selection.

The above description has referred to three levels of pressing load imposed on the top surface of operating member 68. However, the number of levels of pressing load is not limited to this. Similar detection can be performed to adapt to pressing caused by a still greater operating force by providing still another conductive layer around conductive layer 62C, increasing a width of resistive layer 66 and providing still another projection on operating member 68. In other words, a plurality of switch contacts may be formed by providing a plurality of concentric and electrically independent conductive layers, resistive layer 66 having a width corresponding to these conductive layers, and projections corresponding to respective conductive layers. This construction may act for switching between more functions, e.g., for more variations in a moving speed of an indicator displayed on the display unit.

In the above description, push button 78 and operating member 68 are integrally formed by being connected by thin-walled part 78A. However, the push button may be separated from operating member 68 and held by operating member 68 so as to be vertically movable.

According to the present embodiment described above, the multi-directional control switch and the multidirectional input device using this switch each have a simple structure and can be reduced in size.

As in the first embodiment, linear recessed or projected parts may be provided in the top surface of operating member 68 so as to extend radially and outwardly from a substantially central portion of operating member 68.

In the first and second embodiments, only one resistive layer is used. Formation of only one resistive layer is simple and easy. However, discrete resistive layers may be provided to face the conductive layers, respectively.

What is claimed is:

1. A multi-directional control switch comprising:

a disc-shaped operating member;

a ring-shaped resistive layer, with said operating member being movable relative to said resistive layer;

a first ring-shaped conductive layer facing said resistive layer; and a second ring-shaped conductive layer insulated from said first conductive layer and facing said resistive layer, said second conductive layer surrounding and being concentric with said first conductive layer, wherein (i) a first switch contact is defined by said resistive layer and said first conductive layer, with said first switch contact being for outputting a first signal that continuously varies while a top surface of said operating member undergoes a sliding press along a locus in arc form, and (ii) a second switch contact is defined by said resistive layer and said second conductive layer, with said second switch contact being for outputting a second signal while the top surface of said operating member is pressed by a first force.

2. The multi-directional control switch according to claim 1, wherein said first ring-shaped conductive layer has a constant width.

3. The multi-directional control switch according to claim 1, further comprising:

a third switch contact for outputting a third signal when the top surface of said operating member is pressed by a second force greater than the first force.

4. The multi-directional control switch according to claim 3, further comprising:

a third conductive layer insulated from said second conductive layer and facing said resistive layer, said third conductive layer surrounding and being concentric with said second conductive layer, wherein said third switch contact is defined by said resistive layer and said third conductive layer.

5. The multi-directional control switch according to claim 4, wherein said third conductive layer is ring-shaped.

6. The multi-directional control switch according to claim 5, wherein said third conductive layer has a constant width.

7. The multi-directional control switch according to claim 3, wherein said operating member includes, at a bottom surface thereof, a first projection that is to press said third switch contact.

8. The multi-directional control switch according to claim 1, wherein said operating member includes, at a bottom surface thereof, a first projection that is to press said first switch contact.

9. The multi-directional control switch according to claim 8, wherein said first projection is ring-shaped.

10. The multi-directional control switch according to claim 8, wherein said operating member further includes, at the bottom surface thereof, a second projection that is to press said second switch contact, with said second projection being ring-shaped, concentric with and surrounding said first projection.

11. The multi-directional control switch according to claim 7, wherein said operating member further includes, at the bottom surface thereof, a second projection that is to press said second switch contact and a third projection that is to press said first switch contact, with said first projection being ring-shaped, concentric with said third projection, and surrounding said second projection.

12. The multi-directional control switch according to claim 1, wherein said operating member includes, at a bottom surface thereof, a projection that is to press said second switch contact.

13. The multi-directional control switch according to claim 1, wherein said operating member includes one of a recessed part and a projected part extending outwardly from a center of the top surface of said operating member.

14. The multi-directional control switch according to claim 1, further comprising:

a vertically movable push button in a center of said operating member; and a fourth switch contact for outputting a fourth signal while said push button is pressed.

15. The multi-directional control switch according to claim 1, wherein said second conductive layer is ring-shaped.

16. The multidirectional control switch according to claim 15, wherein said second conductive layer has a constant width.

17. The multi-directional control switch according to claim 1, further comprising:

a flexible sheet, wherein said resistive layer is on said flexible sheet.

18. The multi-directional control switch according to claim 17, wherein said flexible sheet comprises a resistive film such that said resistive layer is defined by said resistive film.

19. A multi-directional input device comprising:

a multi-directional control switch including (i) a disc-shaped operating member, (ii) a ring-shaped resistive layer, with said operating member being movable relative to said resistive layer, (iii) a first ring-shaped conductive layer facing said resistive layer, and (iv) a second ring-shaped conductive layer insulated from said first conductive layer and facing said resistive layer, said second conductive layer surrounding and being concentric with said first conductive layer, wherein (a) a first switch contact is defined by said resistive layer and said first conductive layer, with said first switch contact being for outputting a first signal that continuously varies while a top surface of said operating member undergoes a sliding press along a locus in arc form, and (b) a second switch contact is defined by said resistive layer and said second conductive layer, with said second switch contact being for outputting a second signal while the top surface of said operating member is pressed by a first force;

a display unit; and a controller, connected to said multi-directional control switch and said display unit, for controlling display on said display unit upon detection of the first signal and the second signal.

20. The multi-directional input device according to claim 19, wherein said controller is for stopping detection of the second signal while detecting the first signal.

21. The multi-directional input device according to claim 19, wherein said first ring-shaped conductive layer has a constant width.

* * * * *